United States Patent [19]

Rothhaas et al.

[11] 4,257,656

[45] Mar. 24, 1981

[54] FIRE PROTECTION CABINET

[75] Inventors: Friedrich Rothhaas, Bellheim; Günther Pichler, Germersheim, both of Fed. Rep. of Germany

[73] Assignee: Sistemco N.V., Curaco, Netherlands Antilles

[21] Appl. No.: 26,745

[22] Filed: Apr. 3, 1979

[30] Foreign Application Priority Data

Apr. 17, 1978 [CH] Switzerland ..... 4071783

[51] Int. Cl.[3] ..... A47B 81/00

[52] U.S. Cl. ..... 312/214; 312/236

[58] Field of Search ..... 312/214, 236, 257 R; 109/80, 82, 84; 220/9 R

[56] References Cited

U.S. PATENT DOCUMENTS

| | | | |
|---|---|---|---|
| 3,705,754 | 12/1972 | Drum et al. | 312/214 |
| 3,762,787 | 10/1973 | Grubb | 312/214 |
| 3,817,589 | 6/1974 | Anderson | 312/214 |

FOREIGN PATENT DOCUMENTS

| | | | |
|---|---|---|---|
| 7707664 | 6/1977 | Fed. Rep. of Germany . | |
| 1026829 | 1/1964 | United Kingdom | 312/214 |
| 1093147 | 11/1967 | United Kingdom . | |
| 1152724 | 5/1969 | United Kingdom | 312/214 |
| 1213086 | 11/1970 | United Kingdom . | |
| 1500046 | 3/1974 | United Kingdom | 312/214 |

*Primary Examiner*—Casmir A. Nunberg

*Attorney, Agent, or Firm*—Frishauf, Holtz, Goodman & Woodward

[57] ABSTRACT

In the space between an outer casing and the drawer compartments 3, a gypsum filling is devoid of metallic connections between the inner frame 7 and the outer casing. The inner frame 7 is floatingly supported in the gypsum filling. To obtain sufficient cabinet strength, the inner frame 7 is provided with anchoring members extending outwardly which, in the event the cabinet should fall, transmit the forces developed to the gypsum filling without causing overstressing and consequent breakage.

9 Claims, 3 Drawing Figures

FIRE PROTECTION CABINET

The invention refers to a fire protection cabinet in which a gypsum filling is provided in the space between the outer casing and at least one drawer compartment.

In manufacturing such cabinets, the cabinet housing is usually made of an outer casing and an inner casing. In a drawer cabinet there are usually as many inner casings as there are drawers. These inner casings are respectively welded to supports connected to the outer casing. In this way the inner casings are held to receive the drawers in the correct position with respect to the outer casing.

In manufacturing such cabinets, the completed cabinet housing is usually positioned with its front side down for filling the interspaces between the outer casing and the inner casing with a gypsum plaster. After setting of the gypsum plaster, the cabinet can be completed by mounting the rear wall.

Such cabinets have rendered generally good services for years. In case of a fire, when the gypsum is heated, it slowly dissipates the water contained in the gypsum crystals. This causes in known fashion a cooling effect which is generally sufficient to protect the articles contained in the cabinet.

In recent years, fire test requirements have become more severe and cabinets of conventional design have failed to meet the more severe requirements.

It is therefore an object of the present invention to devise a fire protection cabinet of the kind above mentioned which is capable of meeting the severe modern requirements for fire protection.

SUMMARY OF THE INVENTION

Briefly, the inner casing or frame is floatingly suspended in the gypsum filling. It has been found that by such an arrangement heat bridges from the outer casing to the inner casing or frame are prevented, so that the inside temperature remains relatively low.

Up to the present time, no cabinet of such a design has been made available. It may have been feared that a cabinet designed in such a way would not pass a fall test, because insufficient securing of the inner casing might allow portions of the gypsum to be sheared off. There exists also the danger that a drawer could be pulled out so as to drag the inner casing from the cabinet.

According to a preferred embodiment of the invention, outwardly extending anchoring means are provided to anchor the inner casing or frame in the gypsum filling. Preferably, the anchoring means extend at least into the gypsum filling of the side walls. Therefore, in a drawer cabinet the weight of the drawers will be supported by the side walls and not by the region of the gypsum structure limiting the region of the upper drawer with respect to the region of the lower drawer. There, no shearing forces will load the gypsum, but only compression forces, which is more advantageous. The anchoring means extend preferably into the gypsum filling of the rear wall.

In this way, the pulling of the inner casing or frame out of the gypsum by a rapid outward motion of a drawer is avoided.

Preferably, the anchoring means are formed by profiled rods fastened to the inner casing or frame. These profiled members extend preferably over practically the whole width and depth of the inner casing or frame. It is practical for at least one profile to extend over practically the whole width of the inner casing or frame. It is better, however, if each of several profiled members extends a predetermined amount over the width of the inner casing or frame. In this case, the side walls also prevent a pulling-out of the inner casing or frame from the gypsum. To reinforce the gypsum filling, it is preferable for the filling to contain a grid or network, preferably a wire grid or randomly disposed wire mesh.

BRIEF DESCRIPTION OF THE DRAWINGS

The invention is further described by way of illustrative example with reference to the annexed drawings in which.

DESCRIPTION OF THE ILLUSTRATED EMBODIMENT

Figure 1:
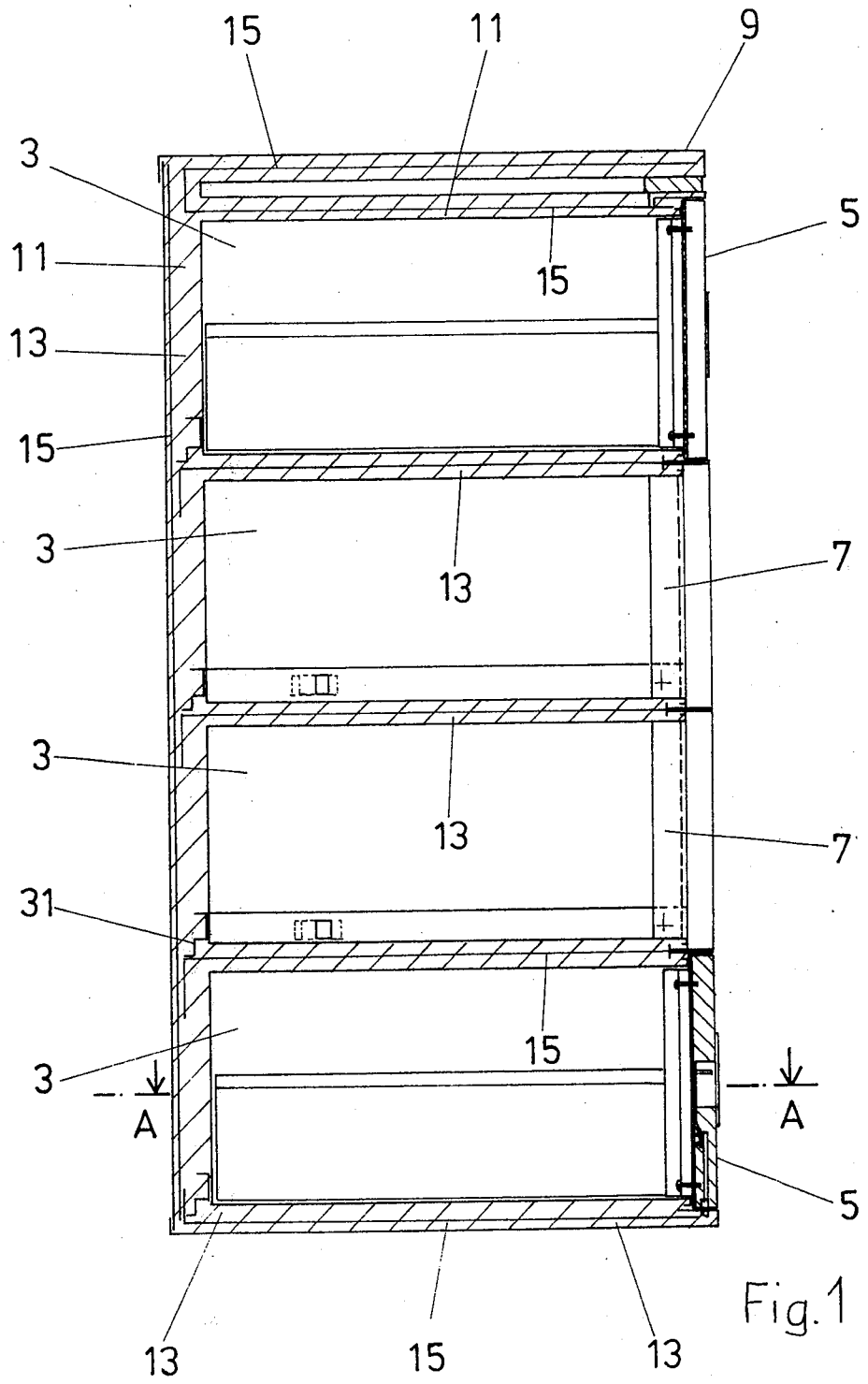
FIG. 1 shows a cross-section through a drawer cabinet according to the invention.
Figure 2:
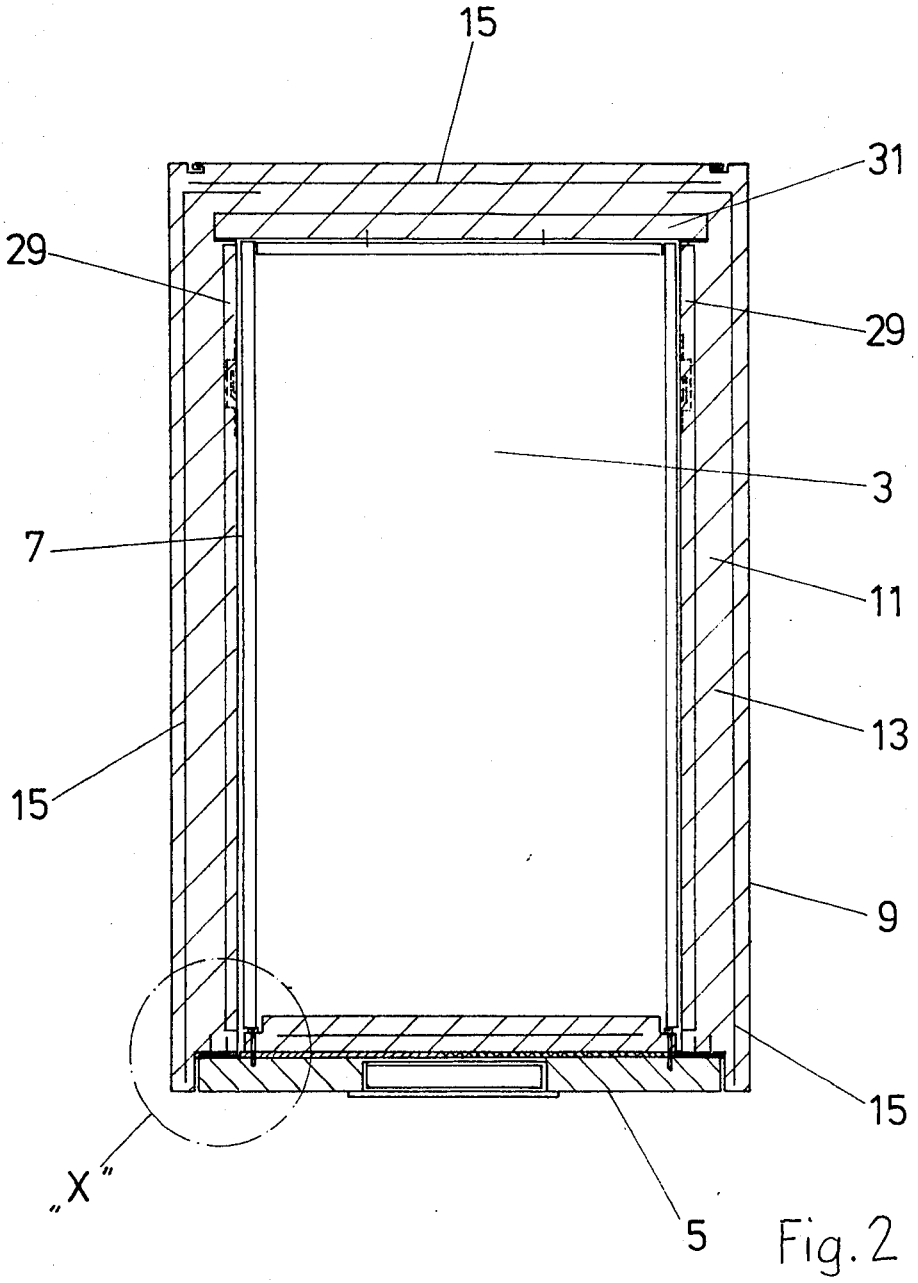
FIG. 2 shows a section along the line A-A of FIG. 1.

The drawer cabinet according to FIG. 1 has four drawer compartments 3. Only the bottom and the top drawer 5 are shown. Each drawer compartment 3 comprises an inner frame 7 preferably made of sheet metal. On this frame 7, rails (not shown) are mounted on which the drawer may run in known fashion. Instead of a frame 7, an inner casing covering the inside of the drawer compartment may also be used.

The outer casing 9 of the cabinet also consists preferably of sheet metal. All spaces 11 between the inner casings 7 and the drawer compartment 3 and between the drawer compartments are filled with a gypsum filling. This gypsum filling consists preferably of porous gypsum. Reinforcement grids 15, normally of wire mesh, are provided.

It is essential for the invention that each inner casing or frame 7 is floatingly supported in the gypsum. There are no metallic contacts between the outer casing 9 and the respective inner casing or frame members 7. This can be seen from FIG. 3, where between the folded parts 12 and 14 of the inner casing or frame 7 and the outer casing 9, there is no structural connection, but only a space filled with gypsum.

Figure 3:
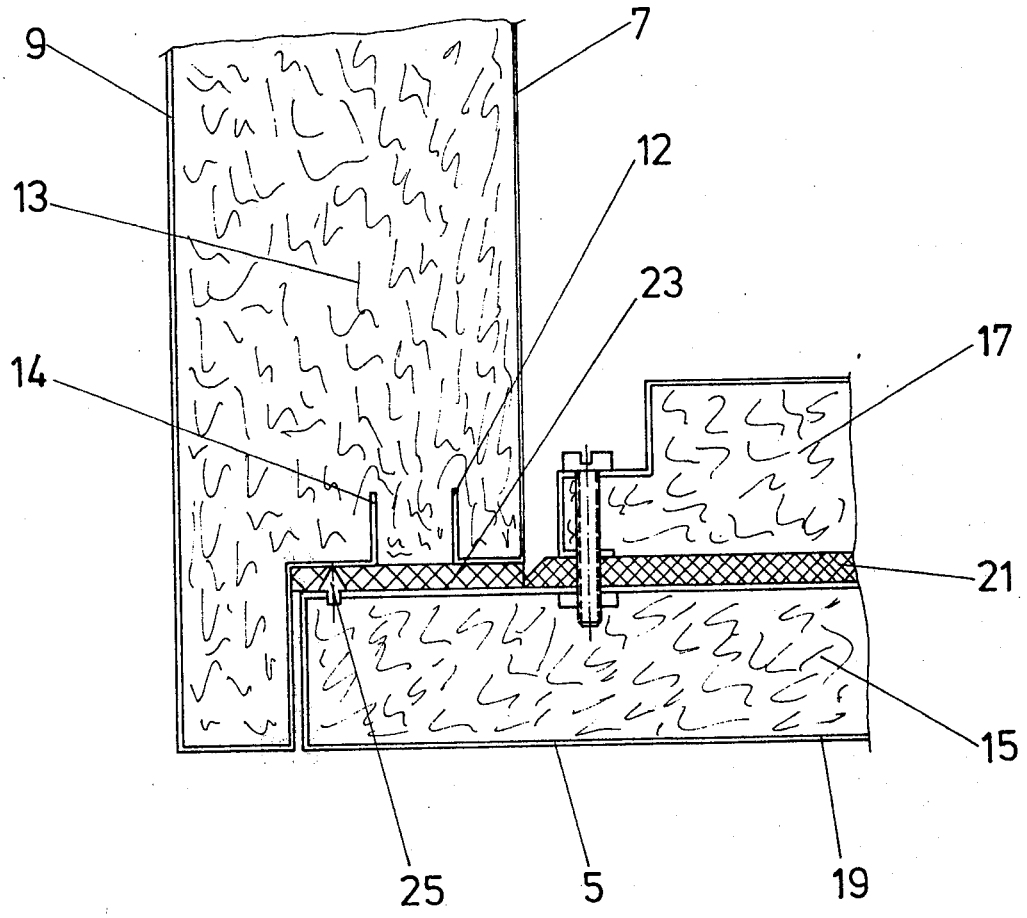
FIG. 3 shows the detail designated x in FIG. 2, on an enlarged scale.

In FIG. 3, the front 19 of a drawer having a gypsum filling 15 and 17 is also visible. Between the gypsum fillings 15 and 17, there is an insulating plate 21. For sealing of the compartment 11, a resilient seal 23 is provided around the drawer opening. The seal preferably consists of a foam sold under the tradename "promatbest". The spacer 25 prevents too strong a compression of the resilient seal 23.

To anchor the inner casing or frame 7 in the gypsum filling 13, anchoring means are provided. In the illustrated example, these anchoring means consist of two profiled rods 29, such as angle bars, T bars, I bars, etc., mounted or formed laterally at the outer surfaces of the inner casing or frame and a profiled rod mounted at the rear outer surface of the inner casing or frame. The profile of this last member is of such configuration that anchoring is provided which secures the inner casing or frame vertically and horizontally. The profiled member 31 extends somewhat at both sides over and beyond the inner casing or frame, so that the side walls also help to prevent pulling-out of the inner casing or frame when a drawer is quickly pulled out.

Although the invention has been described with reference to a particular illustrated example, it will be understood that variations are possible within the inventive concept.

We claim:

1. A fire protection cabinet having an outer casing and an inner structure, said inner structure providing at least one drawer compartment in which a drawer is supported on said inner structure, and having a gypsum filling in the space between said outer casing and said inner structure, and having also the improvement which consists in that:

the inner structure is floatingly suspended and supported in and by the gypsum filling (13); and anchoring means (27,31) extending out from the inner structure into the gypsum filling are provided for anchoring said inner structure in the gypsum filling (13).

2. A cabinet according to claim 1, in which said anchoring means (29) extend at least into the gypsum filling of the side walls.

3. A cabinet according to claim 2, in which said anchoring means also extend into the gypsum filling (13) of the rear wall.

4. A cabinet according to claim 1, in which said anchoring means are constituted by profiled rods fastened to said inner structure.

5. A fire protection cabinet having an outer casing and an inner structure, said inner structure providing at least one drawer compartment in which a drawer is supported on said inner structure, and having a gypsum filling in the space between said outer casing and said inner structure, and having also the improvement which consists in that:

the inner structure is floatingly suspended and supported in and by the gypsum filling (3);

anchoring means (27,31) extending out from the inner structure into the gypsum filling are provided for anchoring said inner structure in the gypsum filling (13), without any metallic connection or contact to said outer casing (9); and said anchoring means are constituted by profiled rods (31,29) fastened to said inner structure and extending practically over the whole width and depth of said inner structure.

6. A cabinet according to claim 4, in which at least one profiled rod (31) extends practically across the whole width of the inner structure (7).

7. A cabinet according to claim 6, in which at least one profiled rod (31) extends to a predetermined extent across the width of the inner structure.

8. A cabinet according to claims 1, 2, 3, 4, 5, 6 or 7, in which said gypsum filling contains a reinforcing grid of tough material (15).

9. A cabinet according to claims 1, 2, 3, 4, 5, 6 or 7, in which said gypsum filling (13) contains a plurality of randomly disposed wire meshes for reinforcement.

* * * * *